US008823511B2

(12) United States Patent
Chien et al.

(10) Patent No.: US 8,823,511 B2
(45) Date of Patent: Sep. 2, 2014

(54) DEVICE AND METHOD FOR BIOLOGICAL MONITORING

(75) Inventors: Jen-Chien Chien, New Taipei (TW); Lung-Te Pan, New Taipei (TW); Huei-Li Chen, New Taipei (TW)

(73) Assignee: BroadMaster Biotech. Corp., New Taipei (TW)

( * ) Notice: Subject to any disclaimer, the term of this patent is extended or adjusted under 35 U.S.C. 154(b) by 66 days.

(21) Appl. No.: 13/469,637

(22) Filed: May 11, 2012

(65) Prior Publication Data

US 2013/0300559 A1 Nov. 14, 2013

(51) Int. Cl.
*G08B 1/08* (2006.01)

(52) U.S. Cl.
USPC ..... 340/539.12; 340/573.1; 340/531

(58) Field of Classification Search
USPC ..... 340/539.12, 573.1, 539.11, 539.1, 340/539.13, 576, 539.17, 531, 539.19, 340/573.4, 539.22
See application file for complete search history.

(56) References Cited

U.S. PATENT DOCUMENTS

| | | | | |
|---|---|---|---|---|
| 5,959,529 | A * | 9/1999 | Kail, IV | 340/539.12 |
| 7,333,718 | B2 * | 2/2008 | Yoshikawa et al. | 386/239 |
| 2006/0241356 | A1 * | 10/2006 | Flaherty | 600/301 |
| 2008/0004811 | A1 * | 1/2008 | Suzuki et al. | 702/19 |
| 2008/0108942 | A1 * | 5/2008 | Brister et al. | 604/118 |
| 2009/0150113 | A1 * | 6/2009 | Kim et al. | 702/127 |
| 2012/0184878 | A1 * | 7/2012 | Najafi et al. | 600/592 |
| 2013/0109997 | A1 * | 5/2013 | Linke et al. | 600/549 |

* cited by examiner

*Primary Examiner* — Daniel Previl
(74) *Attorney, Agent, or Firm* — David Ku

(57) ABSTRACT

An approach is provided for remote healthy caring and monitoring through data transmission and processing. A biological monitoring device comprises a biological sensor, a motion detector, a warning module, a transmitting module and a controller. The biological sensor acquires a biological data from a person. The motion detector senses a variation of acceleration and a variation of angle to acquire a physical condition data. The transmitting module transmits the biological data and the physical condition data to a terminal device. The controller calculates the biological data and the physical condition data based on a predetermined rule, and sends a control signal to trigger a warning module or the transmitting module according to a calculating result. The warning module is configured to send a noticeable signal to inform the person. Therefore, the monitoring range is dynamically adjusted based on the biological and physical of the person.

18 Claims, 3 Drawing Sheets

DEVICE AND METHOD FOR BIOLOGICAL MONITORING

FIELD OF THE INVENTION

Embodiments of the invention relate to a device and a method for biological monitoring, and especially to a biological monitoring device and method that integrated with remote health caring functions.

BACKGROUND

Nowadays, due to their daily life or diet, people could easily suffer from chronic diseases, such as high blood sugar hypertension or high cholesterol. Due to the increasing amount of people who may suffered from such diseases, more people decided spontaneously to purchase a portable blood detector such as a glucose meter for monitoring their physical and health conditions in real time.

Further, with the advance of medical technology, more and more health caring appliances are introduced in the market. One example is a real-time remote monitoring and caring system. It can be implemented by detectors which are carried by elder people. The detector is able to detect and transmit signals in wireless manner to call the emergent medical technician to assist them, when an accident has occurred (i.e. tumble).

The detectors determine the tumble normally according to the variation in acceleration. Such determination is preset by default programs or predetermined. However, even though some detectors could be customized for individual desired, most customizations are establish based on user's appearances (e.g. height, weight or age) and cannot be adjusted dynamically according to their health condition.

Therefore, there is a need for an approach to provide a device, a method or both for biological monitoring that also integrates the remote health care system with dynamically adjustment based on the health condition. Therefore, people not only understand their healthy condition, but also adjust the monitoring setting according to their healthy condition for a precisely monitoring measurement and care.

SOME EXEMPLARY EMBODIMENTS

These and other needs are addressed by the invention, wherein an approach is provided for remote healthy caring and monitoring through data transmission and processing.

According to one aspect of an embodiment of the invention, a biological mentioning device and method acquire a biological data and a physical condition data. The embodiment of the invention may dynamically adjust the effective measurement range in order to monitor and care the user precisely.

According to one embodiment, a device for biological monitoring comprises a biological sensor, a motion detector, a warning module, a transmitting module and a controller. The biological sensor acquires a biological data from a person. The motion detector senses a variation of acceleration and a variation of angle to acquire a physical condition data. The transmitting module transmits the biological data and the physical condition data to a terminal device. The controller calculates the biological data and the physical condition data based on a predetermined rule, and sends a control signal to trigger a warning module or the transmitting module according to a calculating result. The warning module is configured to send a noticeable signal to inform the person.

According to another embodiment, a method for biological monitoring comprises acts of acquiring at least one biological data and at least one physical condition data from the person, wherein the physical condition data comprises a variation of acceleration and a variation of angle; determining a danger threshold and a tumbling threshold according to the biological data; informing the person when the variation of angle is larger than the danger threshold; setting a state of the person in a tumble when the variation of acceleration is larger than the tumbling threshold; determining the posture rehabilitation whereby acquires a new physical condition data from the person after a predetermining duration; and informing a remote medical care system and sending a warming signal to nearby people, when the person is not rehabilitated.

BRIEF DESCRIPTION OF THE DRAWINGS

The invention is illustrated by way of example, and not by way of limitation, in the figures of the accompanying drawings in which like reference numerals refer to similar elements and in which.

DESCRIPTION OF THE PREFERRED EMBODIMENT

Figure 1:
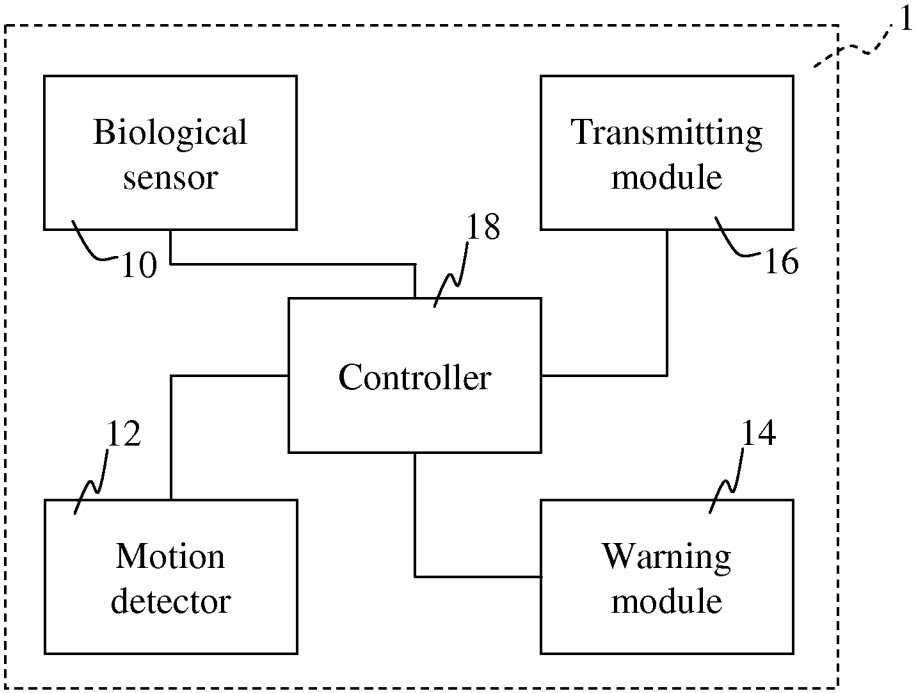
FIG. 1 is an exemplary diagram of a biological monitoring device in accordance with the embodiment of the present invention.

With reference to FIG. 1, FIG. 1 is an exemplary diagram of biological monitoring device in accordance an embodiment with the present invention. In this embodiment, the biological monitoring device 1 may carried by a person, and comprises a biological sensor 10, a motion detector 12, a warning module 14, a transmitting module 16 and a controller 18.

In this embodiment, the biological sensor 10 is a blood testing module (e.g. the glucose meter, the clotting index detector, or the combination). The biological sensor 10 analyses the blood from the person to acquire a biological data.

The motion detector 12 may be a three-axis accelerometer which acquires a physical condition according to a variation of acceleration and a variation of angle of the person. However, the three-axis accelerometer is a commonly known art. Its operation and structure of the three-axis accelerometer will not fully describe in here. The motion detector 12 may further expend its function by combining with a pedometer.

The warning module 14 is configured for sending a noticeable signal to inform the person. For some examples, the noticeable signals can be selected for signals including a vibration, a flash and an audio. The warning module 14 could be implemented in different way according to the types of the noticeable signal. For example, when the noticeable signal is the vibration, the warning module 14 may be a motor, when the noticeable signal is the flash, the warning module 14 may be a light emitting diode (LED) bulb, and when the noticeable signal is the audio, the warning module 14 may be a buzzer.

The transmitting module 16 is configured for transmitting the biological data and the physical condition data to a near or a remote terminal device. For example, the transmitting module 16 may be an IEEE 802.x standard compatible wireless module that transmits the data package to a server of a medical care system through the Internet.

The controller 18 is electrically connected to the biological sensor 10, the motion detector 12, the warning module 14 and the transmitting module 16. The controller 18 is configured for processing the biological data and the physical condition data under a predetermined rule, and sending a control signal to trigger the warning module 14 or the transmitting module 16 according to the calculating result.

Generally, when the motion detector 12 has sensed the variation angle of the person exceeds a particular threshold, the motion detector 12 interprets that the person is in a condition of unstable and may potentially cause the danger of the tumble. Such threshold used for determining the stability of the person is defined as a danger threshold hereinafter. According to a sloping direction of the person (i.e. a frontward plane, a backward plane, a leftward plane and a rightward plane which defined by the three-axis accelerometer), the danger threshold may comprises a frontward angle threshold, a backward angle threshold, a leftward angle threshold and a rightward angle threshold. For example, a general adult person has a frontward sloping angle of 8.5 degree, a backward sloping angle of 4.25 degree, and a leftward or rightward sloping angle of 8 degree. When the variation angle of a person has exceeded the danger threshold either the frontward, the backward or the sideward, the controller 18 will trigger the warning module 14 to inform the person to notice his or her posture that avoids tumble.

According to results of experiment and inductions of statics by the inventor, the tolerant ranges for the variation angle of the adult person are 5.5 to 8.25 degrees for frontward, 2.8 to 4.25 degrees for backward, and 3 to 8 degrees for leftward and rightward. The controller 18 adapted the danger threshold according to the biological data acquired from the biological sensor 10.

For an example, for patients who suffer from atrial fibrillation or venous thrombosis, when their International Normalized Ratio (INR) is smaller than 2, they may exposed in the danger of stroke, and when their INR is greater than 3.9, they may exposed in the danger of cerebral hemorrhage. Therefore, the controller 18 adjusts the danger threshold corresponding to the biological data (i.e. blood concentration) of the person acquired from the biological sensor 10.

Specifically, in most cases, the controller 18 sends the controlling signal to trigger the warning module 14 only when the frontward sloping angle is greater than 8.5 degree. In one example, when the INR of the person is below than 2, the frontward angle threshold will be narrowed to 5.5 degree. The controller 18 triggers the warning module 14 when the frontward sloping angle is greater than 5.5 degree.

Moreover, when the tumble occurs, the motion detector 12 is able to sense the variation of acceleration (hereafter abbreviated as G value (unit: g), G value means gravitational acceleration). G value is an identification of a tumble when is larger than a particular threshold. The controller 18 uses the G value to estimate the seriousness and harmfulness of the tumble. In other words, such G value used to determine the tumble can be defined as "tumbling threshold". As the results of experiment and inductions of statics from the inventor, The G value for an tumbled adult person is preset greater than the threshold which is in the range between 1.8 g to 3.6 g. The controller 18 adjusts the tumbling threshold to adapt the biological condition based on the biological data sensed by the biological module 10.

For an example, the tumbling threshold for a general healthy adult is 3.5 g. The tumbling threshold for a patient who suffers from atrial fibrillation or venous thrombosis is 1.8 g.

Accordingly, the controller 18 could estimate the seriousness of tumble according to the G value. For an example, it could regard as a self-tumbling (i.e. without external forces) when the G value exceeds the tumbling threshold which is in the range of 1.8 g to 3.5 g. It could regard as an accident such as a collision or a falling from a height place when the tumbling threshold which is in or exceeds the range of 3.5 g to 10 g.

It is noted that the controller 18 may further adjust the determining rule and seriousness of the tumble according to the age, height or weight of the person. For an example, if a young person is measured with a G value under a 2 g falling acceleration, the controller 18 will determine the person is in a harmless tumbling status. On the other hand, for the elder person who is over 80 years old, the tumble with 1.8 g acceleration could cause fatal accident.

In addition, the determining rule could be a firmware coding in a storage unit (not shown in the figure) of the controller 18. The controller 18 may be a programmable controller, and the storage unit may be a Read-Only Memory (ROM).

Therefore, comparing to the ordinary biological sensor and motion detector, the controller 18 of the embodiment in accordance with the present invention is able to use the biological data and the physical condition data simultaneously for dynamically adjusting the danger threshold and the tumbling threshold, which provides more precise elevation and monitoring of the state of the person.

Figure 2:
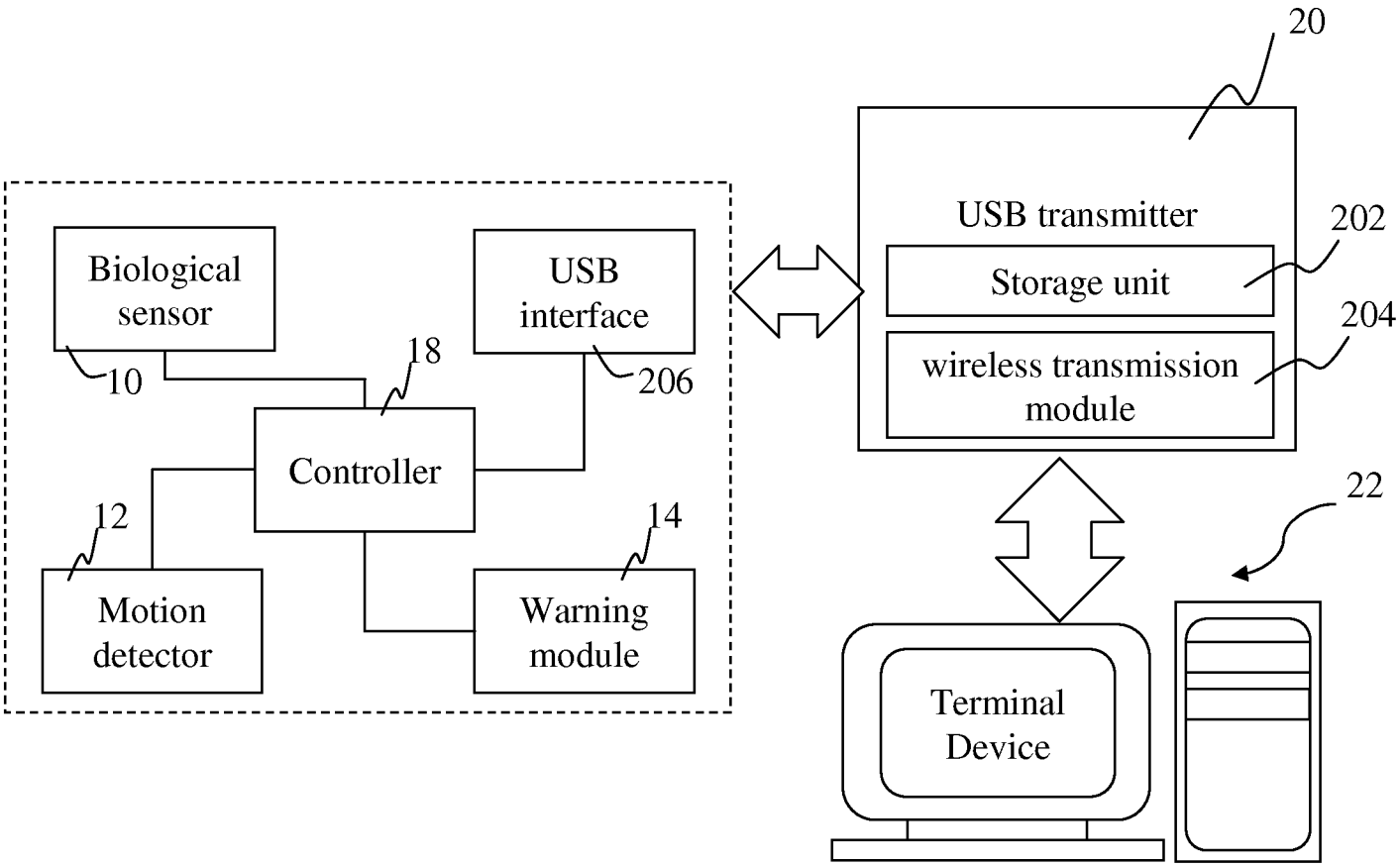
FIG. 2 is another exemplary diagram of a biological monitoring device in accordance with the embodiment of the present invention.

With reference to FIG. 2, FIG. 2 is an exemplary diagram of biological monitoring device in accordance with an embodiment of the present invention. The biological monitoring device, in this embodiment, is similar to that in previous embodiment. The major difference is that the transmitting module 16 is a USB transmitter 20 with wireless transmission function (known as the USB Dongle). The USB transmitter 20 has a storage unit 202 (e.g. a flash memory) and a wireless transmission module 204. The controller 18 accesses the biological data and the physical condition data in the storage unit 202 through a USB interface 206.

The USB transmitter 20 has the advantage of high storage volume and mobility. For an example, when a person goes to the hospital, the he or she can remove the USB transmitter 20 from the biological sensing device and plug it directly to the terminal device 22 (e.g. the server in the hospital) for data transmission. In such manner, the effort of inquiring history data could be reduced and the power used for wireless transmission can be also saved.

The wireless transmitting module 204 may be a wireless module that meets the IEEE 802.x standard, a Bluetooth module, a Zigbee module, a Near Field Communication (NFC) module or a 3G module.

Figure 3:
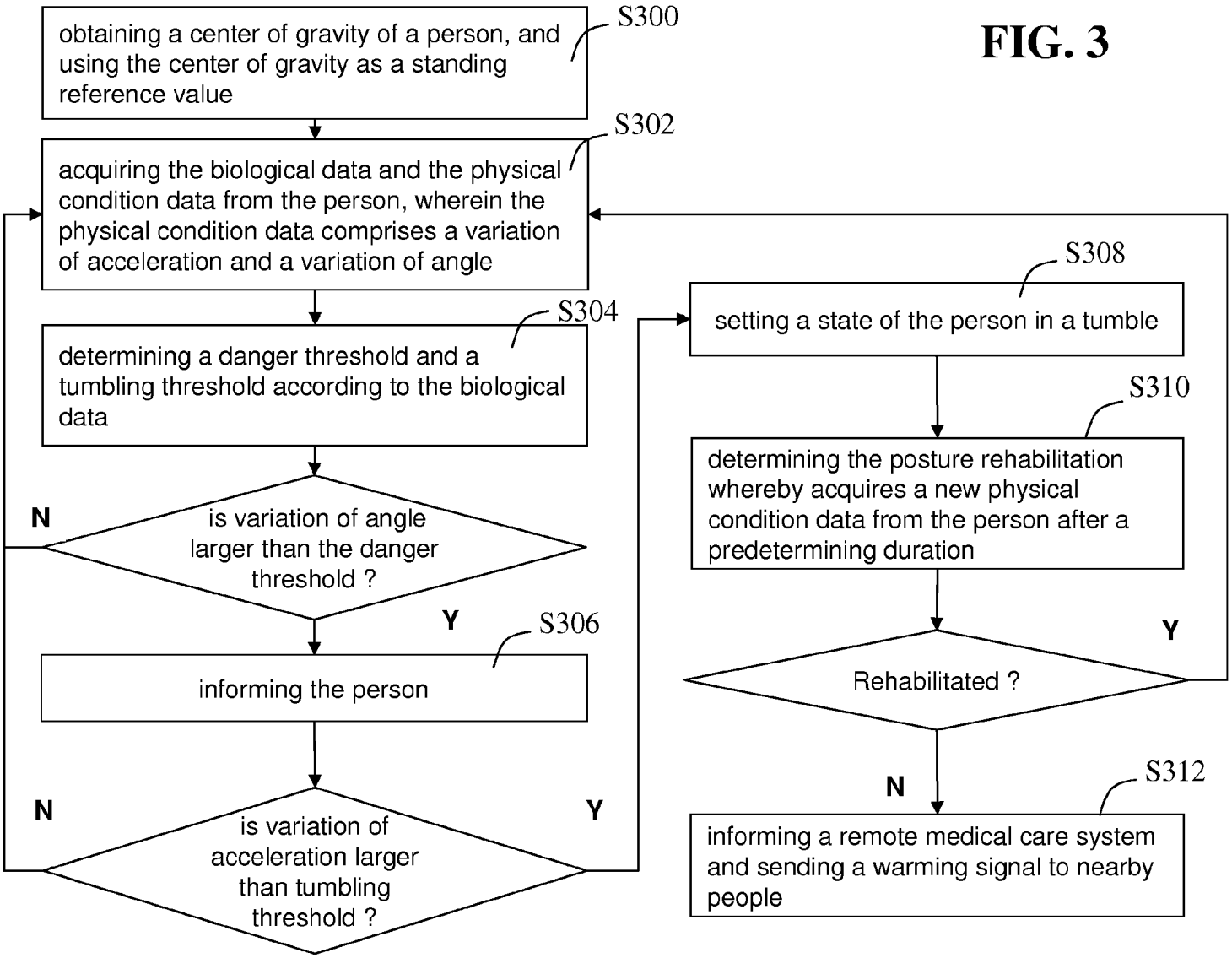
FIG. 3 is a flow chart of a biological monitoring method in accordance with the embodiment of the present invention.

With reference to FIG. 3, FIG. 3 is a flow chart of a biological monitoring method in accordance with an embodiment of the present invention. The biological monitoring method comprises step of S300 obtaining a center of gravity of a person, and using the center of gravity as a standing reference value, S302 acquiring at least one biological data and at least one physical condition data from the person, wherein the physical condition data comprises a variation of acceleration and a variation of angle, S304 determining a danger threshold and a tumbling threshold according to the biological data, S306 informing the person when the variation of angle is larger than the danger threshold, S308 setting a state of the person in a tumble when the variation of acceleration is larger than the tumbling threshold, S310 determining the posture rehabilitation whereby acquires a new physical condition data from the person after a predetermining duration, and S312 informing a remote medical care system and sending a warming signal to nearby people, when the person is not rehabilitated.

The center of gravity of S300 is the center of gravity of the body that a person can take balance while standing on, and thus the center of gravity is used for the standing reference value.

The biological data of S302 a blood glucose concentration or an International Normalized Ratio. The danger threshold and the tumbling threshold of S304, the danger threshold comprises a frontward angle, a backward angle, a leftward angle and a rightward angle. The values of the frontward angle, the backward angle, and the sideward angle (i.e. the leftward angle and the rightward angle) may be configured between 5.5-8.25 degree, 2.8-4.25 degree and 3-8 degree, respectively.

The step of S312 informs the remote medical care system through a wireless transmission mechanism. The wireless transmission mechanism can be implementing using an IEEE 802.x standard compatible wireless module, a Bluetooth module, a Zigbee module, a NFC (Near Field Communication) module or a 3G module.

Therefore, though the mentioned device and method, the invention is able to adjust the effective monitoring range dynamically. The invention not only senses the biological and physical condition of a person in real-time but also dynamically adjust the effective monitoring range according condition of the person. Therefore, an effective health caring and a precise emergency alert can be provided by this invention.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A device for biological monitoring carried by a person, comprising:

a biological sensor acquiring a biological data from the person;

a motion detector sensing a variation of acceleration and a variation of angle to acquire a physical condition data;

a warning module being configured to send a noticeable signal to the person;

a transmitting module transmitting the biological data and the physical condition data to a terminal device; and a controller being electrically connected to the biological sensor, the motion detector, the warning module and the transmitting module, calculating the biological data and the physical condition data based on a predetermined rule, and sending a control signal to trigger the warning module or the transmitting module according to a calculating result.

2. The device as claimed in claim 1, wherein the predetermined rule comprises a danger threshold and a tumbling threshold.

3. The device as claimed in claim 2, wherein the calculating result is the result of comparing the danger threshold or the tumbling threshold with the physical condition data.

4. The device as claimed in claim 2, wherein the danger threshold is corresponding to a sloping direction of the person, and comprises a frontward angle threshold, a backward angle threshold, a leftward angle threshold and a rightward angle threshold.

5. The device as claimed in claim 4, wherein the frontward angle threshold is selected from a value between 5.5 degree and 8.25 degree, the backward angle threshold is selected from a value between 2.8 degree and 4.25 degree, the leftward angle threshold and the rightward angle threshold are selected from values between 3 degree and 8 degree.

6. The device as claimed in claim 2, wherein the tumbling threshold is selected from a gravitational acceleration value between 1.8 g and 3.6 g.

7. The device as claimed in claim 1, wherein the biological sensor is a blood testing module, and the biological data is a blood glucose concentration.

8. The device as claimed in claim 1, wherein the biological sensor is a blood testing module, and the biological data is International Normalized Ratio.

9. The device as claimed in claim 1, wherein the motion detector is a three- axis acceleration.

10. The device as claimed in claim 1, wherein the transmitting module is a USB transmitter.

11. The device as claimed in claim 10, wherein the USB transmitter comprises a storage unit and a wireless transmission module, the controller accesses the biological data and the physical condition data in the storage unit through a USB interface.

12. A method for biological monitoring, comprising:

acquiring at least one biological data and at least one physical condition data from the person, wherein the physical condition data comprises a variation of acceleration and a variation of angle;

determining a danger threshold and a tumbling threshold according to the biological data;

informing the person when the variation of angle is larger than the danger threshold;

setting a state of the person in a tumble when the variation of acceleration is larger than the tumbling threshold;

determining the posture rehabilitation whereby acquires a new physical condition data from the person after a predetermining duration; and informing a remote medical care system and sending a warning signal to nearby people, when the person is not rehabilitated.

13. The method as claimed in claim 12, before acquiring the biological data and the physical condition data, further comprising:

obtaining a center of gravity of a person, and using the center of gravity as a standing reference value.

14. The method as claimed in claim 12, wherein the biological data is a blood glucose concentration.

15. The method as claimed in claim 12, wherein the biological data is International Normalized Ratio.

16. The method as claimed in claim 12, wherein the danger threshold is corresponding to a sloping direction of the person, and comprises a frontward angle threshold, a backward angle threshold, a leftward angle threshold and a rightward angle threshold.

17. The method as claimed in claim 16, wherein the frontward angle threshold is selected from a value between 5.5 degree and 8.25 degree, the backward angle threshold is selected from a value between 2.8 degree and 4.25 degree, the leftward angle threshold and the rightward angle threshold are selected from values between 3 degree and 8 degree.

18. The method as claimed in claim 12, wherein the tumbling threshold is selected from a gravitational acceleration value between 1.8 g and 3.6 g.

* * * * *